US009936786B2

(12) United States Patent
Grez et al.

(10) Patent No.: US 9,936,786 B2
(45) Date of Patent: Apr. 10, 2018

(54) VACUUM INFUSION HAIR COLORING APPLIANCE

(71) Applicant: L'Oréal, Paris (FR)

(72) Inventors: Joseph Grez, North Bend, WA (US); Zane Miller, Seattle, WA (US)

(73) Assignee: L'Oreal, Paris (FR)

( * ) Notice: Subject to any disclaimer, the term of this patent is extended or adjusted under 35 U.S.C. 154(b) by 122 days.

(21) Appl. No.: 14/738,507

(22) Filed: Jun. 12, 2015

(65) Prior Publication Data

US 2016/0360851 A1 Dec. 15, 2016

(51) Int. Cl.

| | |
|---|---|
| ***A45D 19/18*** | (2006.01) |
| *A45D 19/00* | (2006.01) |
| *A61H 7/00* | (2006.01) |

(52) U.S. Cl.

CPC ..... *A45D 19/18* (2013.01); *A45D 2019/0066* (2013.01); *A61H 7/006* (2013.01)

(58) Field of Classification Search

CPC ..... A45D 19/00; A45D 19/06; A45D 19/14; A45D 19/18; A45D 2019/0033; A45D 2019/0041; A45D 2019/0055; A45D 2019/0058; A45D 2019/0066; A45D 2019/0083; A45D 2019/0091; A45D 20/18

USPC ..... 132/212, 221; 601/11, 17

See application file for complete search history.

(56) References Cited

U.S. PATENT DOCUMENTS

| | | | | | |
|---|---|---|---|---|---|
| 809,360 | A * | 1/1906 | Dible | A61H 9/005 | 601/12 |
| 1,355,679 | A * | 10/1920 | McConnell | A61H 9/005 | 601/12 |
| 2,049,035 | A * | 7/1936 | Wilsey | A45D 6/06 | 132/206 |
| 2,655,145 | A * | 10/1953 | Heger | A61H 9/005 | 601/12 |
| 2,856,918 | A * | 10/1958 | Kingery | A45D 19/14 | 132/202 |
| 3,177,868 | A * | 4/1965 | Wallace | A45D 19/14 | 132/202 |
| 3,182,666 | A * | 5/1965 | Watkins | A45D 19/02 | 132/212 |
| 3,516,411 | A * | 6/1970 | Adler | A61B 5/441 | 601/7 |
| 4,074,369 | A * | 2/1978 | Harmon | A45D 19/14 | 34/100 |
| 4,469,092 | A * | 9/1984 | Marshall | A61H 7/006 | 601/136 |
| 4,769,861 | A * | 9/1988 | Chang | A45D 19/14 | 4/515 |
| 4,836,192 | A * | 6/1989 | Abbate | A61H 9/005 | 601/11 |
| 5,203,357 | A * | 4/1993 | Vigliotti | A45D 7/00 | 132/210 |

(Continued)

*Primary Examiner* — Tatiana Nobrega

(74) *Attorney, Agent, or Firm* — Clark A. Puntigam; Jensen & Puntigam, P.S.

(57) ABSTRACT

The hair coloring appliance includes a flexible cap which is adapted and sized to fit against the head of the user, covering the user's hair. The cap includes a sealing band which seals the edge of the cap to the user's head. A vacuum pump assembly is connected to the cap as well as a color infusion assembly. A control system controls the vacuum assembly to create a vacuum in the cap volume and to permit infusion of color material when the desired vacuum has been created.

19 Claims, 6 Drawing Sheets

(56) References Cited

U.S. PATENT DOCUMENTS

| | | | | | |
|---|---|---|---|---|---|
| 5,228,431 | A * | 7/1993 | Giarretto | A61H 7/006 | 601/11 |
| 5,454,778 | A * | 10/1995 | Liaskos | A61H 9/005 | 601/12 |
| 5,897,512 | A * | 4/1999 | Zagame | A61H 7/008 | 601/6 |
| 6,024,100 | A * | 2/2000 | Fukuyama | A45D 19/16 | 132/200 |
| 7,530,961 | B1 * | 5/2009 | Griffin | A61H 7/006 | 4/515 |
| 9,462,867 | B2 * | 10/2016 | Li | A61H 15/00 | |
| 2005/0171457 | A1 * | 8/2005 | Yang | A61H 7/001 | 601/11 |
| 2008/0066336 | A1 * | 3/2008 | Kuechler | A45D 19/16 | 34/99 |

* cited by examiner

VACUUM INFUSION HAIR COLORING APPLIANCE

TECHNICAL FIELD

This invention relates generally to hair coloring systems and methods, and more particularly concerns such a system and/or method which aids a user in applying coloring material to the user's hair.

BACKGROUND OF THE INVENTION

In hair coloring, it is important that the coloring be uniform, if so intended, meaning that the color is the same over the entire area of the user's hair, and that the coloring be complete, i.e. all of the user's hair is colored. In many cases, particularly with coloring at home by a user, it is often difficult to obtain complete color over the entire amount of the user's hair; for regions at the back of the head, which are difficult for a user to accurately see, even with a mirror and good lighting. The quality of hair coloring, particularly at home, is dependent upon the user's skill in applying the hair color. It is quite common for a user to be dissatisfied with the results of home hair coloring. This is true relative to the uniformity of the color, if desired, as well.

Further, home hair coloring is often messy, and usually requires more time and effort in cleanup than is desired. In some cases, there is an accompanying odor which can be unpleasant. Still further, home hair coloring requires certain minimum implements and/or materials.

Hence, it is desirable that a home hair coloring appliance or method be developed which results in reliable, uniform (if desired) hair coloring with complete coverage.

SUMMARY OF THE INVENTION

Accordingly, one aspect of the invention is an appliance for coloring hair, comprising: a flexible cap adapted to fit against the head of a user and cover the user's hair, wherein the cap includes at least one vacuum port through which air in a volume between the cap and the head is drawn out, and at least one infusion port through which hair coloring material is moved into the volume, through infusion action; and a sealing band member which seals the cap to the head of the user, such that the volume between the cap and the head is substantially fluid tight.

Another aspect of the invention is a method for coloring hair, comprising the steps of: fitting a flexible cap to the head of a user, enclosing the hair of the user therebetween; creating a vacuum within the volume between the head of the user and the cap; providing of hair coloring material into the volume in which the vacuum has been created; wherein the color infusion terminates when the pressure from the environment is equal to the pressure within the cap; activating the coloring material at a selected point in the process; and removing the flexible cap.

A further aspect of the invention is in an appliance for coloring hair: a flexible cap portion adapted to fit against the head of a user and cover the user's hair, wherein the cap includes at least one port through which air in a volume between the cap and the head of a user is drawn out, thereby creating a vacuum in the cap volume and at least one port through which hair coloring material is drawn into the volume through infusion action, wherein the flexible cap includes a sealing band member which seals the cap to the head of a user.

BEST MODE FOR CARRYING OUT THE INVENTION

The present invention is an appliance/device for reliably and uniformly applying hair color to a user's hair, particularly useful for home hair coloring. It generally includes a flexible cap, similar to a shower cap, which fits over the hair of a user, encompassing the user's hair. The invention is a vacuum infusion system, accomplishing desired uniformity and completeness of the hair coloring.

Figure 1:
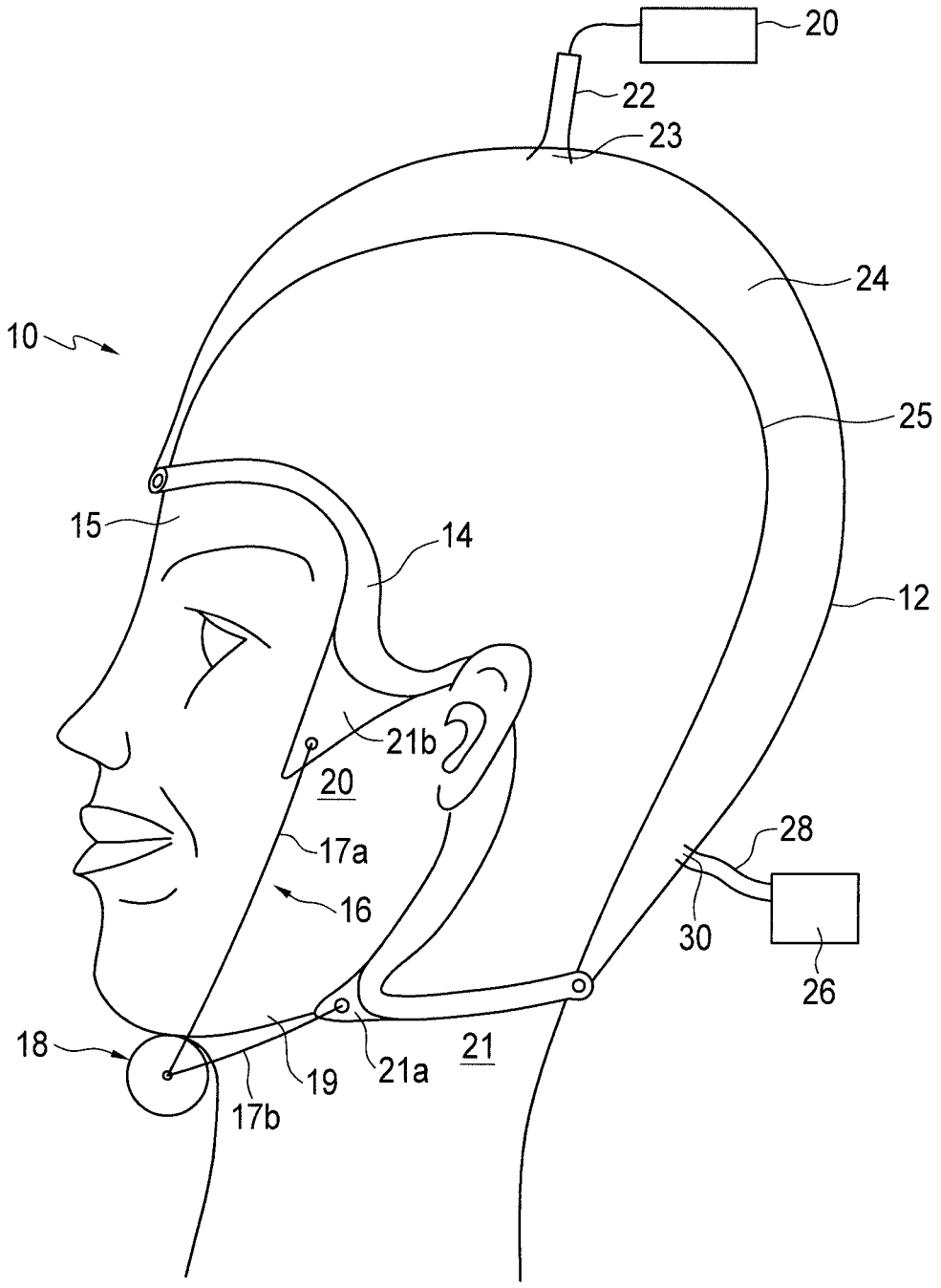
FIG. 1 is a side view of the system of the present invention in place on a user's head.

One embodiment of the invention is shown in FIG. 1. The appliance, shown generally at 10, includes a cap 12 which is made of flexible, but typically not stretchable, material, similar to a conventional shower cap. The cap 12 fits over a major portion of the user's head from the forehead to the neckline, and is sized and adapted to encompass all of the user's hair to be colored hair (not shown in FIG. 1 for clarity). The edge of the cap 12 is sealed to the user's head by a sealing band 14 which is configured to prevent the escape of hair coloring material from the volume between the hair and the cap. In FIG. 1, the band 14 extends across the forehead 15 of the user, down around the eyes, around in back of the ears, down and along the jaw line below the ears and then across the back of the neck 21 of the user. The cap 12 is held in place by an assembly 16, comprising anchoring lines 17*a*, 17*b*, which connect spaced tab portions of the cap to a padded element 18, which extends beneath the chin of the user. The anchoring lines 17*a*, 17*b*, in the embodiment shown extend from tab elements 21*a*, 21*b* near the jaw 19 and the upper cheek 20, but they can be connected to other cap points as well. Assembly 16 is designed to maintain the cap 12 in place during the coloring process and prevent coloring fluid from escaping from the cap.

The appliance of FIG. 1 includes a vacuum pump 20 and a vacuum connecting line 22, to a vacuum port 23 in the cap, into the volume 24 between the cap and the head 25 of the user, at the top of the cap. Various vacuum pumps can be used; one example is a pump manufactured by Airpower, model D2028. Vacuum pump 20 in operation creates a vacuum in the volume between the cap and the user's head.

The seal band between the cap and the head is important for proper operation of the appliance. Generally, the pump 20 will be operated until an approximate 95% vacuum is achieved, although this can vary, as explained in more detail below.

The appliance of FIG. 1 also includes a color reservoir 26 and a reservoir line 28, which is secured to a color infusion port 30 in the cap 12 near the neck line of the user.

Briefly, in operation, the vacuum pump, when it is turned on, will create a vacuum within the volume 24 between the cap and the head of the user. The color infusion line is closed until the desired vacuum is reached. The vacuum pump is typically then turned off, and the color infusion line is opened. The vacuum in the cap volume 24 will quickly draw color material into the volume from reservoir 26. The color material will spread uniformly around and throughout the hair within volume 24 producing uniform and complete coloring.

Figure 2:
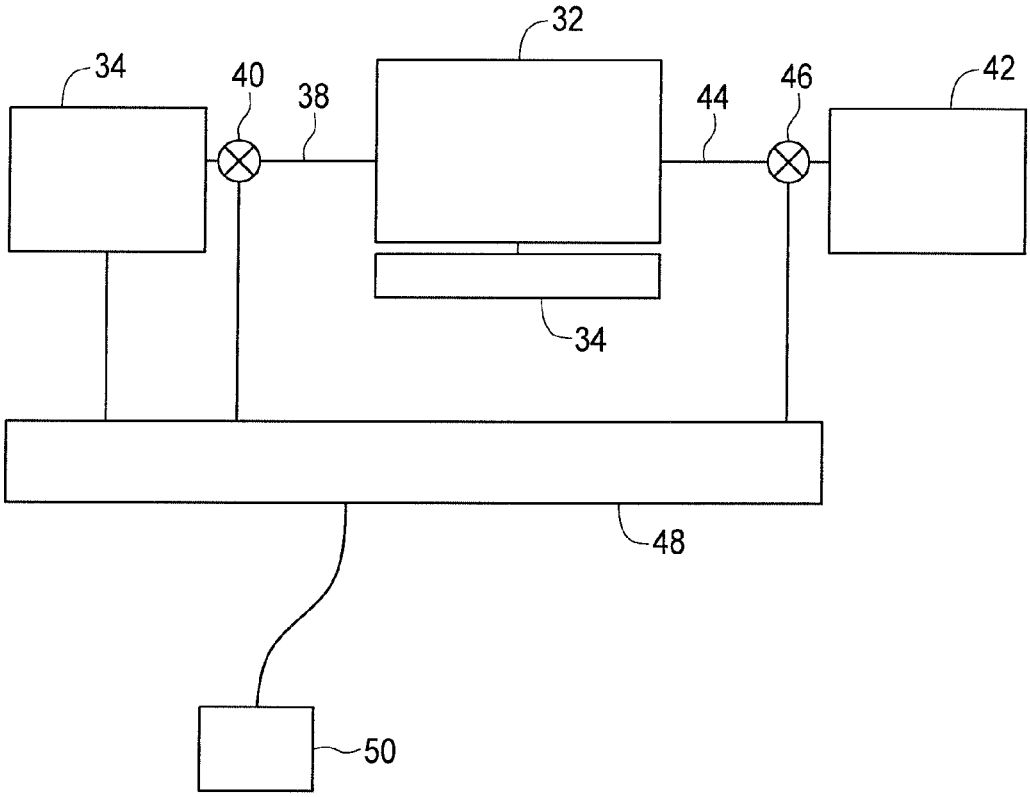
FIG. 2 is a block diagram of the functional portion of the system.

FIG. 2 is a block diagram of the structure of the appliance. The system includes a cap 32 as discussed above which is sealed to the head of the user by a seal member 34, sufficient that a vacuum is produced in the volume between the cap and the head. A vacuum pump 34 is connected to the cap 32 by a connecting line 38. The connection between the vacuum pump and the cap is controlled by a valve 40. The system also includes a color reservoir 42 and a connecting line 44 to the cap 32. A valve 46 in line 44 is operated to open or close the line 44. The operation of the vacuum pump, valve 40 and valve 46 are controlled by a control system 48 which is powered by a power supply 50, but could also be manually operated, such as by hand. The power supply could be batteries or the wall power system. It is not necessary for the fluid reservoir to be controlled. Again, the vacuum pump is operated and the valve 40 is opened to produce a vacuum in the volume between the cap and the seal around the head. When the desired vacuum is accomplished, valve 40 is closed. Valve 46 is then opened. The color material in the color reservoir 42 is drawn into the volume by the vacuum therein, i.e. an infusion of color occurs into the volume between the cap and the head, i.e. an infusion into the volume containing the user's hair to be colored.

Figure 3:
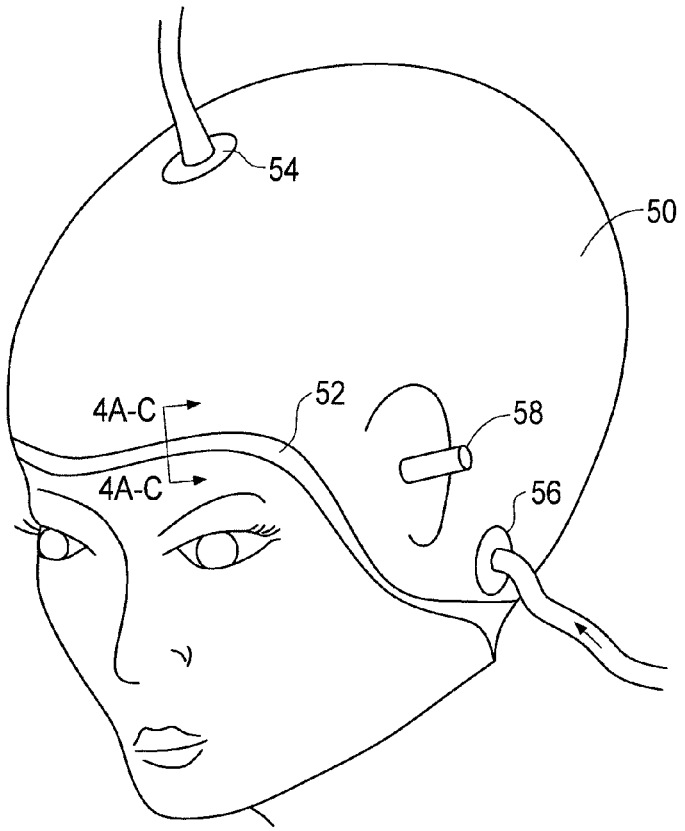
FIG. 3 is a perspective view of another embodiment of the system of the present invention.

The embodiment of FIG. 1 shows a cap with a seal band which goes around and behind the ears of the user. In the alternative embodiment of FIG. 3, the cap 50 covers the ears of the user, with the sealing band 52 being extending in front of the ear. The embodiment of FIG. 3 is otherwise similar to that of FIG. 1, with a vacuum port 54 at the top of the cap and the color infusion port 56 positioned at the neck line. There is an ear vent 58 within the ear cover over the ear canal which allows the user to hear.

Figures 4A, 4B, 4C:
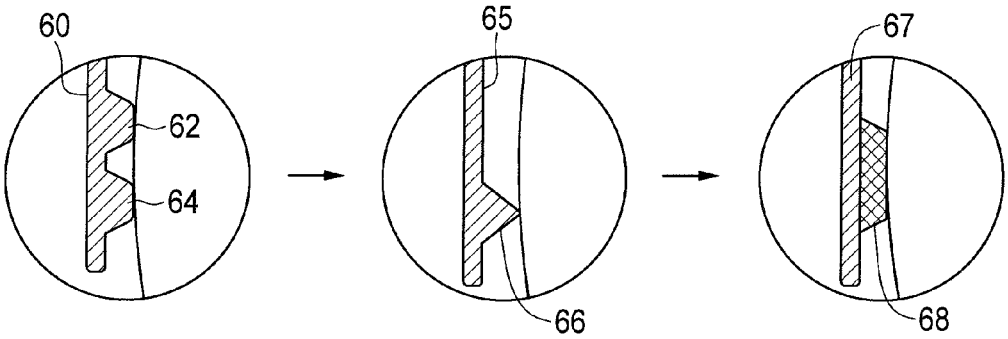
FIG. 4A is a partial sectional diagram of a portion of the system of the present invention.
FIG. 4B is an alternative to the portion of FIG. 4A.
FIG. 4C is another alternative to the portion of FIG. 4A.

FIGS. 4A-4C show three possible variations of the sealing structure between the band at the edge of the cap and the user's head. FIG. 4A is a cross-section of a band 60 having two generally parallel flexible beads 62, 64 along its interior surface. The band is tightened sufficiently by the structure of FIG. 1 that the beads continuously contact the skin, creating an effective air-tight seal. FIG. 4B is a cross-section of another band structure 65 with a pointed bead 66 along its interior surface, with the bead contacting the skin in an air-tight arrangement. FIG. 4C shows a band 67 with an interior strip 68 of tacky material which attaches or secures to the skin of the user, resulting in an effective air-tight seal.

Figure 5:
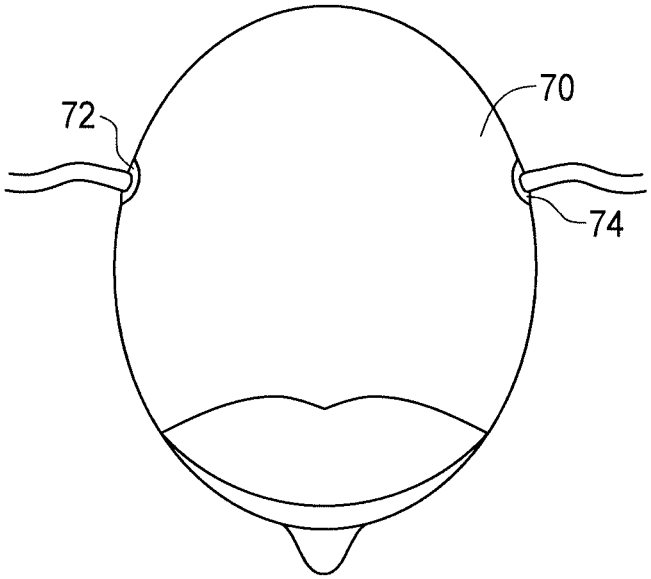
FIG. 5 is a top view of a variation of FIG. 1.

FIG. 5 is a top view of an embodiment of a cap 70 where the vacuum port 72 is located at one side of the cap above one of the ears and slightly to the rear thereof, while the color infusion port 74 is located at the opposing side of the cap.

Figure 6A:
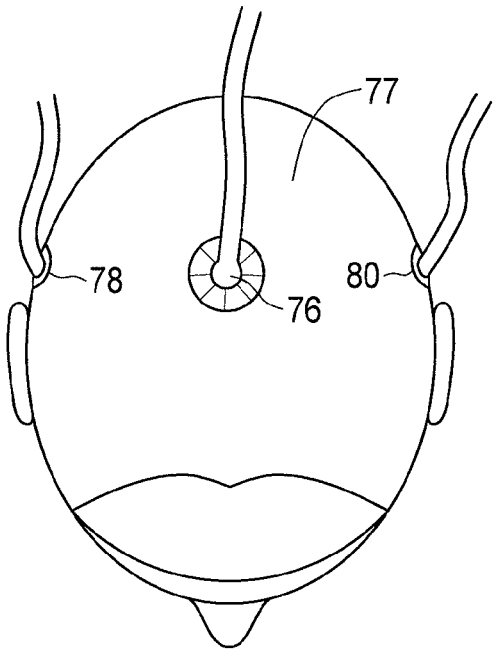
FIG. 6A is a top view of another variation of the embodiment of FIG. 1.
Figure 6B:
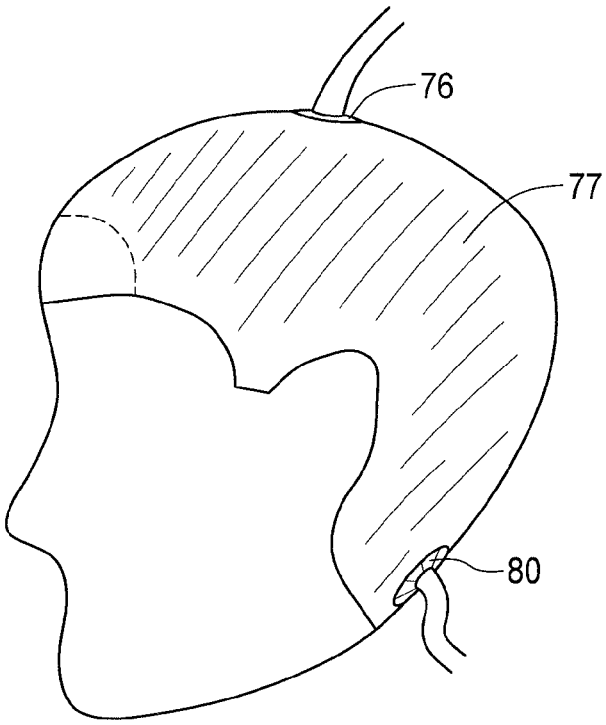
FIG. 6B is a side view of the variation of FIG. 6A.

It should be understood that there may be multiple vacuum lines and ports and multiple infusion lines and portions. One example is shown in FIGS. 6A and 6B, with a vacuum port 76 at the top of cap 77, and two color infusion ports 78, 80 on opposing sides of the cap, slightly to the rear of the ears on the cap. The sealing band in this embodiment is similar to that of FIG. 1, within the band exterior behind the ears and around the forehead and neck regions of the user.

The multiple vacuum and/or infusion lines are helpful in obtaining complete and uniform coverage, although good results can be obtained with one vacuum line and one infusion line.

Figure 7A:
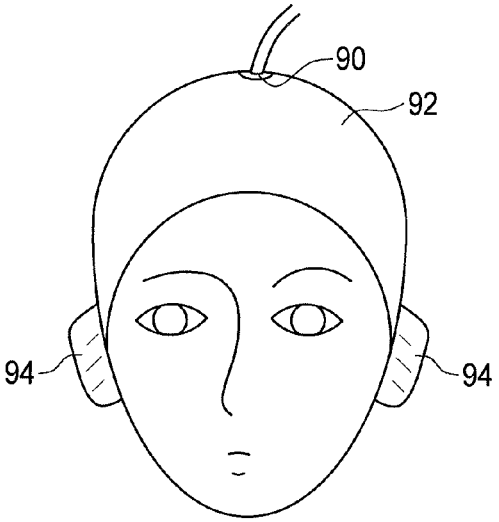
FIG. 7A is a front view of another variation of the invention of FIG. 1.
Figure 7B:
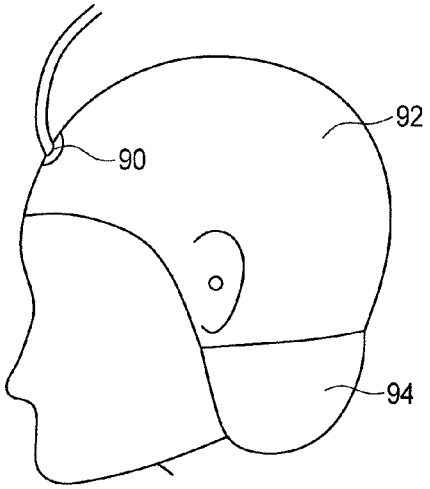
FIG. 7B is a side view of the embodiment of FIG. 7A.
Figure 7C:
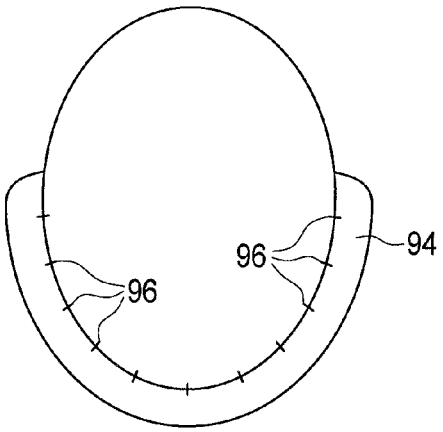
FIG. 7C is a top view of the embodiment of FIGS. 7A and 7B.
Figure 8A:
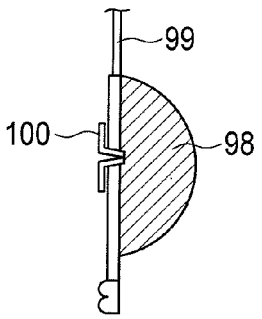
FIG. 8A is a partial sectional view of a portion of the embodiment of FIGS. 7A-7C.
Figure 8B:
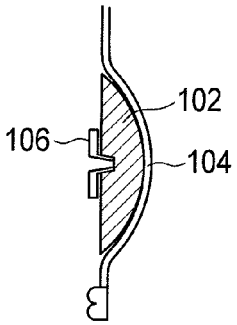
FIG. 8B is an alternative to the portion of FIG. 8A.

FIGS. 7A-7C show another embodiment, in which vacuum port 90 is positioned at the top of the cap 92, but close to the front edge thereof, while the color reservoir 94 is integral with the cap and extends around the cap at the neck adjacent the lower edge of the cap. The integrated reservoir is typically about two inches high and extends around a lower edge portion of the cap. A plurality of openings 96-96 is typically provided between the cap and the integrated reservoir, as shown in FIG. 7C. The openings are created by hollow needles which puncture the integrated reservoir when the user presses against the reservoir toward the user's head. FIG. 8A shows one embodiment where the integrated reservoir 98 is positioned outside the cap 99. Pressure against the reservoir results in hollow needles 100 penetrating the reservoir, allowing color material to move into the cap volume. FIG. 8B is a variation with the reservoir 102 being positioned on the inside surface of the cap 104, with the hollow needles 106 positioned adjacent the reservoir but not actually penetrating the reservoir. Pressure forces the hollow needles through the reservoir, allowing color material to move into the volume.

Figure 9:
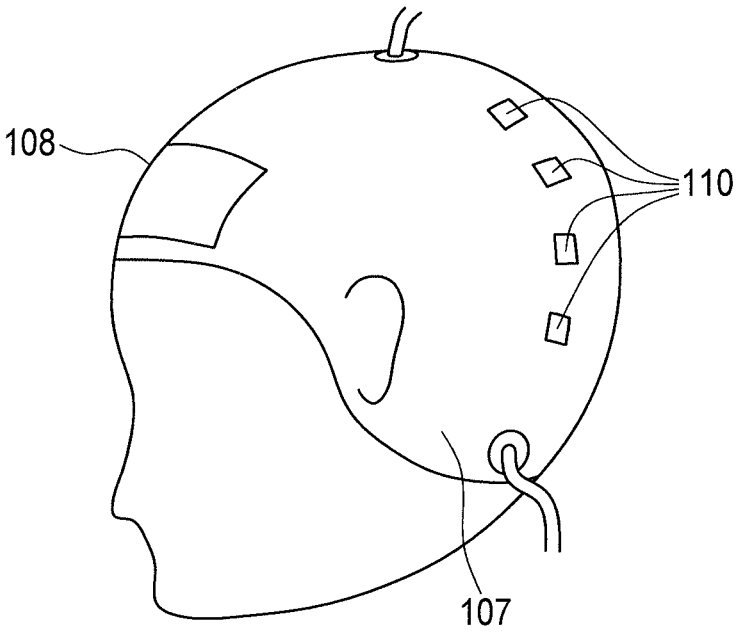
FIG. 9 is a simplified view of FIG. 1 with additional capability.

FIG. 9 shows additional features which could be incorporated into the cap 107, including a transparent window 108 for viewing and sensors 110-110 for monitoring the color.

The above system has a number of advantages. First, it typically uses less coloring material than conventional coloring systems and reliably produces complete and uniform coverage, without special efforts or expertise of the user. The actuation of the color material can also be accomplished more easily by simply running hot water over the shower cap. This can be done, for instance, in the shower. When the coloring infusion is complete and the color formulation activated, the shower cap can simply be removed and discarded, along with the hair coloring reservoir or packet. In some cases, the shower cap structure can be cleaned and used again.

While typically a high vacuum (90-95%) is created in the cap volume and then the control valve is closed, the vacuum connection line can be left open with the vacuum pump in operation drawing the color material into the volume from the color reservoir. This can be done with lower vacuum values before the color infusion valve is opened or even when there is little or no actual vacuum when the infusion valve is opened.

Accordingly, a hair coloring device is disclosed which includes a flexible cap portion which is sealed to the skin of the user and encompasses the user's hair. A vacuum pump and line is used to create a vacuum in the enclosure. When the vacuum is completed, a line to the hair coloring reservoir can be opened, with the hair coloring formulation quickly moving into the volume, resulting in complete coverage of the hair, filling in the voids between the individual hairs.

Although a preferred embodiment of the invention has been disclosed for purposes of illustration, it should be understood that various changes, modifications and substitutions may be incorporated in the embodiment without departing from the spirit of the invention, which is defined by the claims which follow.

What is claimed is:

1. An appliance for coloring hair, comprising:

a flexible cap adapted to fit against the head of a user and cover the user's hair, wherein the cap includes at least one vacuum port through which air in a volume between the cap and the head is drawn out, wherein the flexible cap includes a hair color reservoir integral with the cap and at least one infusion port through which hair coloring material is moved into the volume, through infusion action, the integrated color reservoir including punctureable elements between the integrated color reservoir and the volume, allowing color material in the color reservoir to move into the volume; and a sealing band member which seals the cap to the head of the user, such that the volume between the cap and the head is substantially fluid tight.

2. The appliance of claim 1, wherein the appliance includes a vacuum assembly which comprises:

a vacuum pump;

a connection line between the vacuum pump and the vacuum port;

a valve for opening and closing the vacuum connecting line;

a connecting line between the hair color reservoir and the infusion port; and a control valve for opening and closing the infusion port connecting line.

3. The appliance of claim 2, including a control system operably coupled to the vacuum assembly, the control system configured for controlling the operation of the valve of the vacuum connecting line and/or the control valve of the infusion port connecting line.

4. The appliance of claim 2, including multiple vacuum line connections.

5. The appliance of claim 2, including multiple color infusion port line connections.

6. The appliance of claim 1, wherein the vacuum port is located near the top of the head when the cap is in place on the user, and wherein the infusion ports are positioned behind the ears of the user.

7. The appliance of claim 1, wherein the sealing band extends around and behind the ears of the user, when the cap is in lace on the user's head.

8. The appliance of claim 1, wherein the cap includes an outlet and when the cap is in lace on the user's head, the cap covers the ears and the outlet is between the ear canal and the environment.

9. The appliance of claim 1, wherein the sealing band includes a strip of tacky material which connects the sealing band to the head of the user.

10. The appliance of claim 1, including a tightening assembly between the cap and the head of the user when the cap is in lace on the user's head.

11. The appliance of claim 1, wherein the cap includes a transparent window.

12. The appliance of claim 1, including sensors located in the cap.

13. In an appliance for coloring hair:

a flexible cap portion adapted to fit against the head of a user and cover the user's hair, wherein the cap includes at least one vacuum port through which air in a volume between the cap and the head of a user is drawn out, thereby creating a vacuum in the cap volume and at least one infusion port through which hair coloring material is drawn into the volume through infusion action, wherein the cap includes a fluid reservoir integrated with the cap and hollow needle members for penetrating the cap and the integrated fluid reservoir, wherein the flexible cap includes a sealing band member which seals the cap to the head of a user.

14. The cap of claim 13, including multiple vacuum ports.

15. The cap of claim 13, including multiple color infusion ports.

16. The cap of claim 13, wherein the vacuum port is located near the top of the head when the cap is in place on a user, and wherein the at least one infusion port is/are positioned behind the ears of the user when the cap is in place on a user.

17. The cap of claim 13, wherein the sealing band member extends around the back of the ear of the user when the cap is in place on the user's head.

18. The cap of claim 13, wherein the sealing band member includes a strip of tacky material which seals the cap to the head of the user.

19. The cap of claim 13, wherein the sealing band member includes a strip of flexible material for contact with the user's head, and the cap includes a tightening arrangement, for tightening the sealing band member against the head of the user.

* * * * *